United States Patent [19]

Forberg et al.

[11] Patent Number: 4,533,196

[45] Date of Patent: Aug. 6, 1985

[54] DEVICE FOR MAKING A SOLDERLESS, NON-SCREWED AND UNSTRIPPED SINGLE OR MULTIPLE CONTACT AT A TERMINAL ELEMENT

[75] Inventors: Horst Forberg; Klaus-Peter Achtnig; Gunter Hegner; Gerhard Boes, all of Berlin, Fed. Rep. of Germany

[73] Assignee: KRONE GmbH, Berlin, Fed. Rep. of Germany

[21] Appl. No.: 409,370

[22] Filed: Aug. 19, 1982

[30] Foreign Application Priority Data

Sep. 19, 1981 [DE] Fed. Rep. of Germany ..... 3137429

[51] Int. Cl.[3] ..... H01R 9/08

[52] U.S. Cl. ..... 339/97 P

[58] Field of Search ..... 339/98, 99 R, 97

[56] References Cited

U.S. PATENT DOCUMENTS

| | | | |
|---|---|---|---|
| 4,002,391 | 1/1977 | Dunn et al. | 339/98 |
| 4,030,799 | 6/1977 | Venaleck | 339/99 R |
| 4,127,312 | 11/1978 | Fleishhacker | 339/99 R |
| 4,274,696 | 6/1981 | Long et al. | 339/98 |
| 4,283,103 | 8/1981 | Forberg et al. | 339/97 P |

FOREIGN PATENT DOCUMENTS

| | | |
|---|---|---|
| 1765584 | 3/1972 | Fed. Rep. of Germany . |
| 2142850 | 3/1973 | Fed. Rep. of Germany . |
| 2338056 | 2/1974 | Fed. Rep. of Germany . |
| 1907950 | 8/1977 | Fed. Rep. of Germany . |
| 2854681 | 6/1980 | Fed. Rep. of Germany . |
| 2814069 | 6/1981 | Fed. Rep. of Germany . |
| 3021798 | 12/1981 | Fed. Rep. of Germany . |

*Primary Examiner*—Joseph H. McGlynn

*Attorney, Agent, or Firm*—Baker, Maxham, Callan & Jester

[57] ABSTRACT

A device comprising a plurality of terminal elements (1) for making a solderless, non-screwed and unstripped connection of one or several wires to each terminal element (1). The terminal elements (1) are constructed either as double-contacts (1*a*) or as multiple contacts (1*b*) having transverse webs (3, 4, 5, 6). Each of the webs comprises a contact slot (2) and is oriented at an angle of about 45 degrees to the wire axis and, is disposed in parallel to each other.

3 Claims, 8 Drawing Figures

DEVICE FOR MAKING A SOLDERLESS, NON-SCREWED AND UNSTRIPPED SINGLE OR MULTIPLE CONTACT AT A TERMINAL ELEMENT

The invention relates to a novel device comprising a plurality of terminal elements for solderless, non-screwed and unstripped termination of one or several wires to each terminal element, said terminal elements each being formed of leaf-shaped resilient contact material and including at least two slots. The main portion of each slot, which extends from an enlarged insertion mouth and is defined by sharp edges having a width which, due to the inclined orientation between wire and terminal element, is smaller than the size of the metal core of the wire. Upon the wire being urged into the slot the wire insulation is severed and a contact is made between the wire and the terminal element.

A solderless, non-screwed and unstripped terminal (briefly: LSA-termnal; LSA originates from "löt-, schraub- und abisolierfrei") comprising double-contacts for termination of two adjacent communication cable wires or jumper wires has been known in various embodiments.

Thus, the DE-OS No. 2,142,850 shows an electrical connector for connecting one or several insulated wires to a terminal having at least two slots, and the DE-PS No. 1,765,584 shows a terminal connector for connecting one or two insulated wires to a terminal element having two slots each formed by two contact arms which ar resilient relative to each other and are suitable for removing the wire insulation.

These known terminals can and should be improved, because they are expensive to manufacture and require considerable space because of the constructionally caused large contact spacing when placed side by side.

The DE-OS No. 2,338,056 shows a V-shaped terminal element comprising two slots, one of said slots retaining and the other one contacting a wire.

Both slots are of different design.

A drawback of the above-specified temrminal element is the excessive space requirement when inserted into terminal strips. Furthermore, the contact arms are rigidly disposed.

The DE-OS No. 3,021,798 shows a V-shaped terminal element designed as a double-contact, each arm of the terminal element forming a single solderless, non-screwed and unstripped contact.

It is a drawback of this double-contact that the wires cannot be connected successively but only simultaneously to the terminal element. The spacing of the wires, which are connected in parallel, is twice the wall thickness of the resilient material employed. Because of its V-shape and the mutual support between the inner contact arms caused thereby this terminal element is only suitable for the simulataneous termination of two wires to be connected.

It is therefore the object of the present invention to avoid the drawbacks specified above.

In accordance with the invention the above-specified object is solved in that each terminal element is designed as a double-contact or a multiple contact. The transverse webs of each terminal element, which are each formed with a contact slot and are disposed at an angle of about 45 degrees to the wire axis, are disposed in parallel to each other, whereby the axial spacing of at least two interconnected adjacent wires is determined by the wall thickness of the resilient contact material. The central webs of each terminal element are extended in an upward direction and are provided at the ends thereof with retaining means.

Advantageous further embodiments of the individual measures of the present invention are characterized in the subclaims.

In accordance with the invention extensions are integrally formed beneath the terminal elements, one arm of each extension forming one half of a contact member, so that it is possible in the assembled state of the terminal elements in the terminal strip to insert arresters or breaking and, respectively, testing plugs.

The following essential advantages are achieved by the novel connecting device according to the invention:

1. The space requirement of the terminal elements is considerably reduced for each wire as compared to known devices, so that two interconnected adjacent wires are held in spaced relationship only by the wall thickness of the resilient contact material.
2. The novel terminal elements also permit successive connection and disconnection of wires without affecting the function of respective adjacent wires.

The invention will be explained in detail by means of the embodiments thereof as shown in the drawing, in which.

Figure 5:
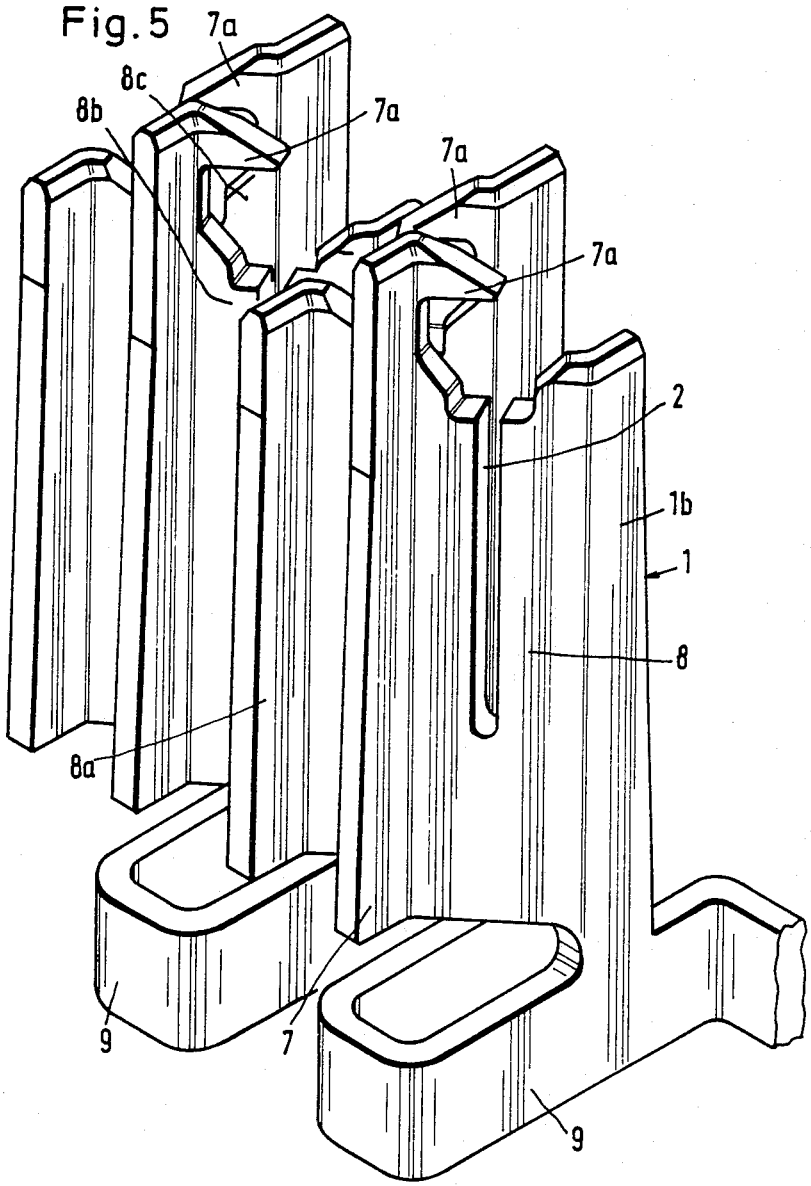
FIG. 5 is a terminal element constructed as a multiple contact.
Figure 6:
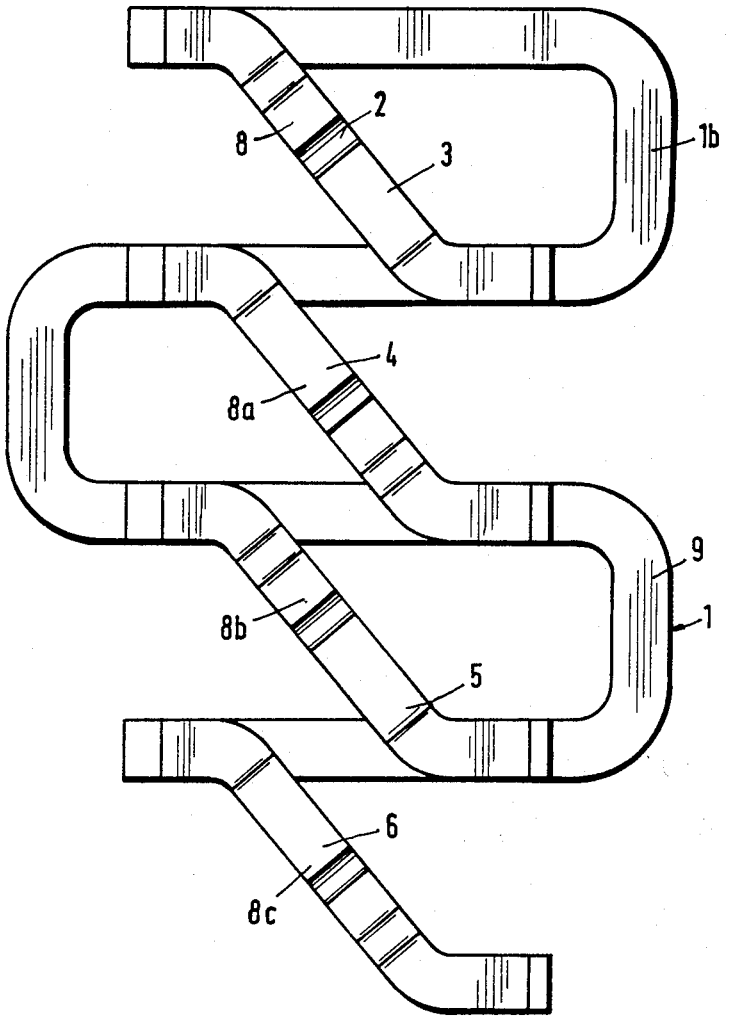
Figure 7:
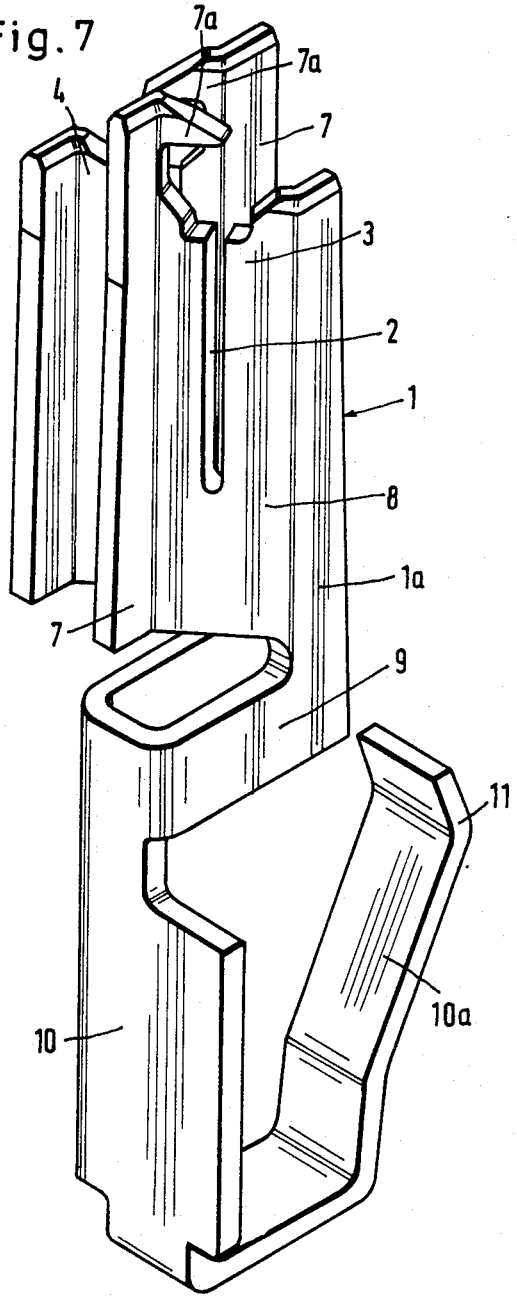
Figure 8:
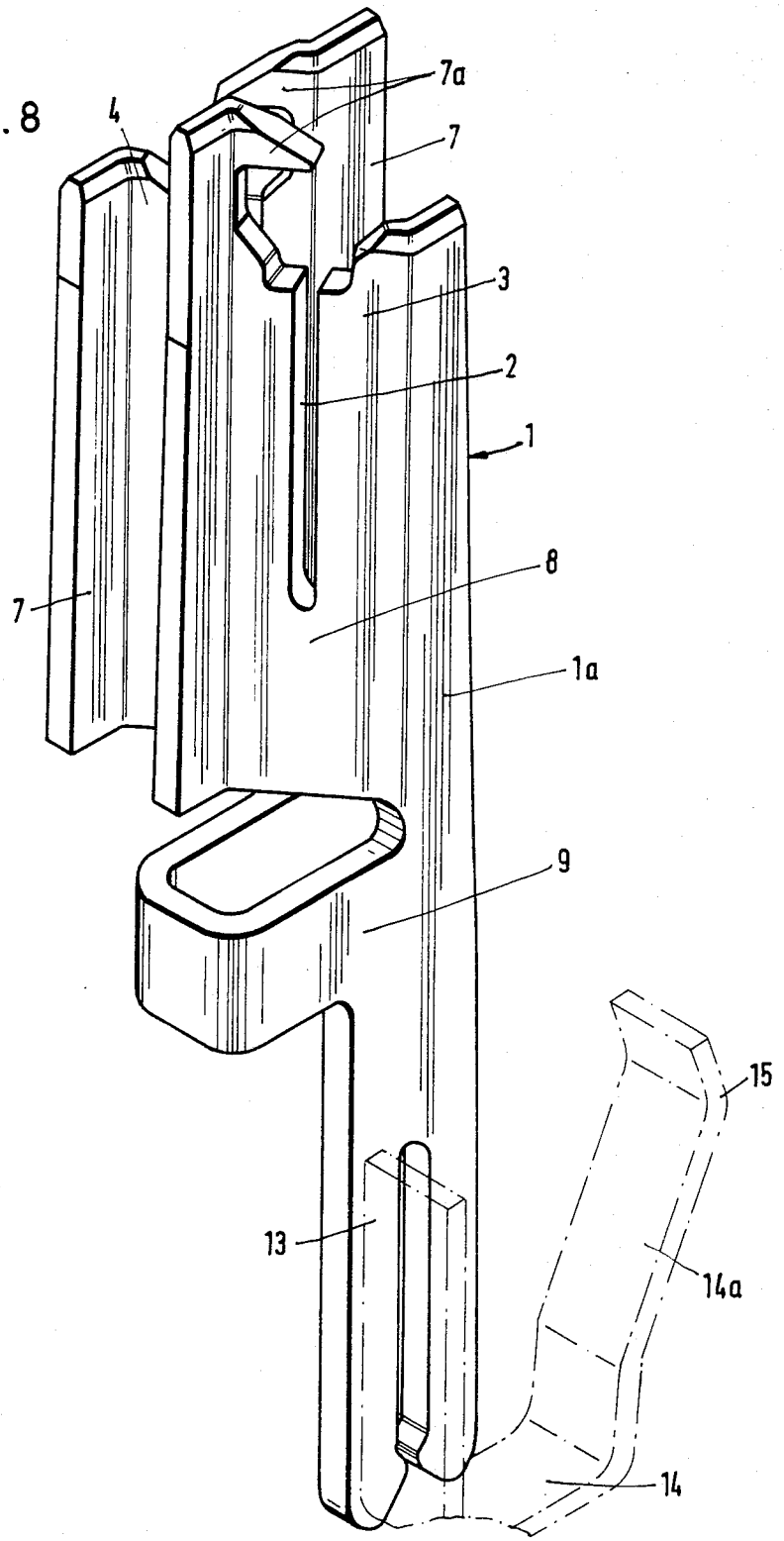

FIG. 6. is a plan view of FIG. 5;

FIG. 7 is a terminal element constructed as a double-contact and having an extension integrally formed therewith; and FIG. 8 is a terminal element constructed as a double-contact and having an insertable extension.

Figure 1:
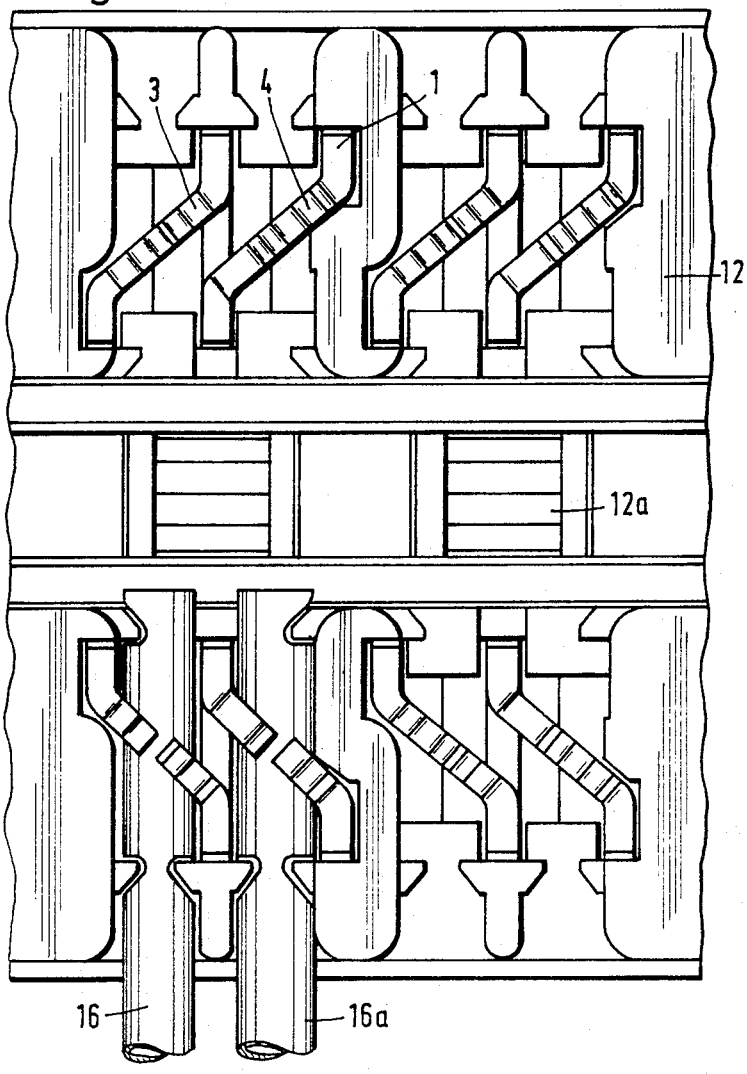
FIG. 1 is a fragmentary view of a terminal strip with inserted terminal elements, the latter being formed as double-contacts.
Figure 2:
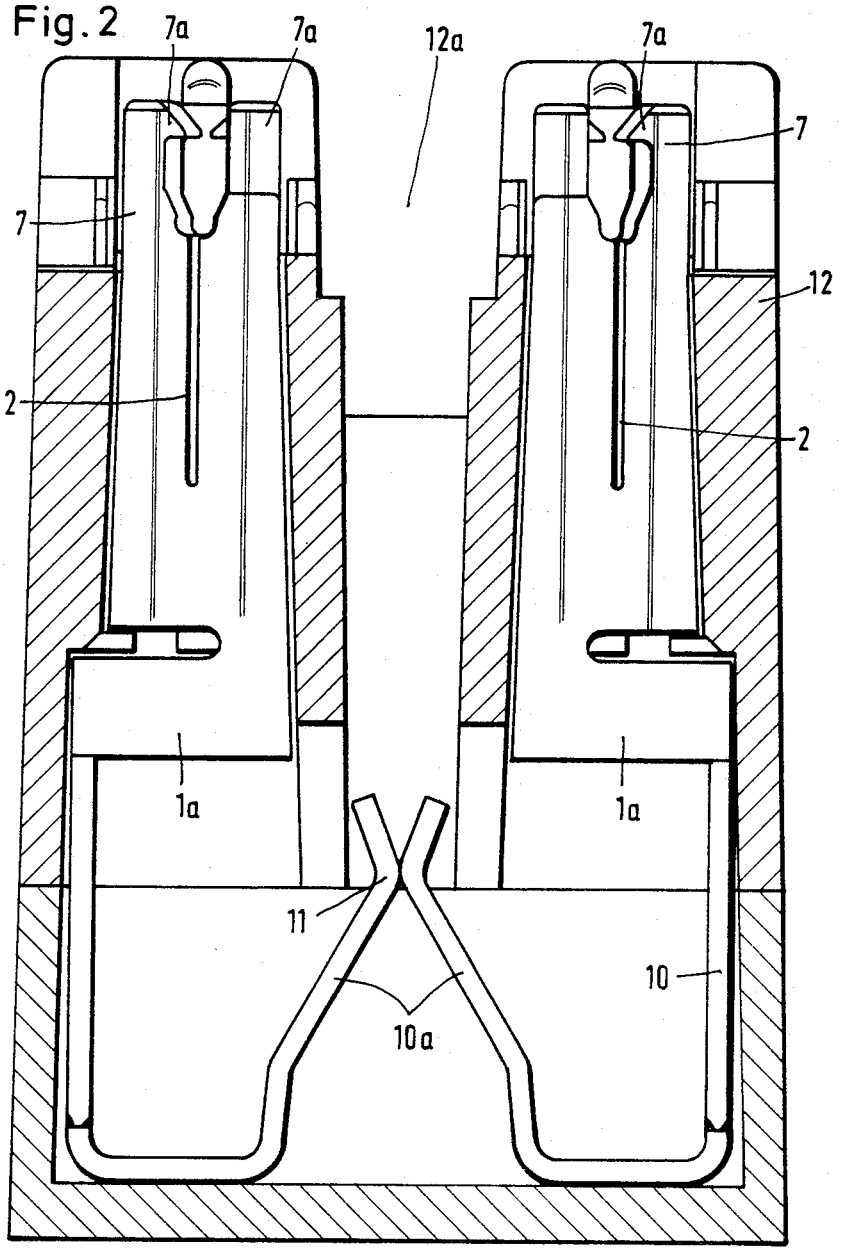
FIG. 2 is a cross-sectional view according to FIG. 1.

As will be apparent from FIGS. 1 and 2, the terminal elements 1 are adapted to be inserted into the terminal strip 12.

The transverse webs 3, 4, which are disposed at about 45 degrees to the wire axis and are formed with a contact slot 2, are disposed parallel to each other and thereby permit termination of a multiplicity of wires 16, 16*a*, because it is only the wall thickness of the resilient contact material which determines the spacing between two adjacent wires 16, 16*a*. For example, wires 16, 16*a* in FIG. 1 are spaced only by the thickness of these portions 7 of the terminal element which lie between them (See FIGS. 1 and 3).

Furthermore, it is possible in a manner known per se to insert arrester magazines or connectors for testing and breaking purposes. For this purpose openings 12*a* are provided in the top of terminal strip 12.

Figure 3:
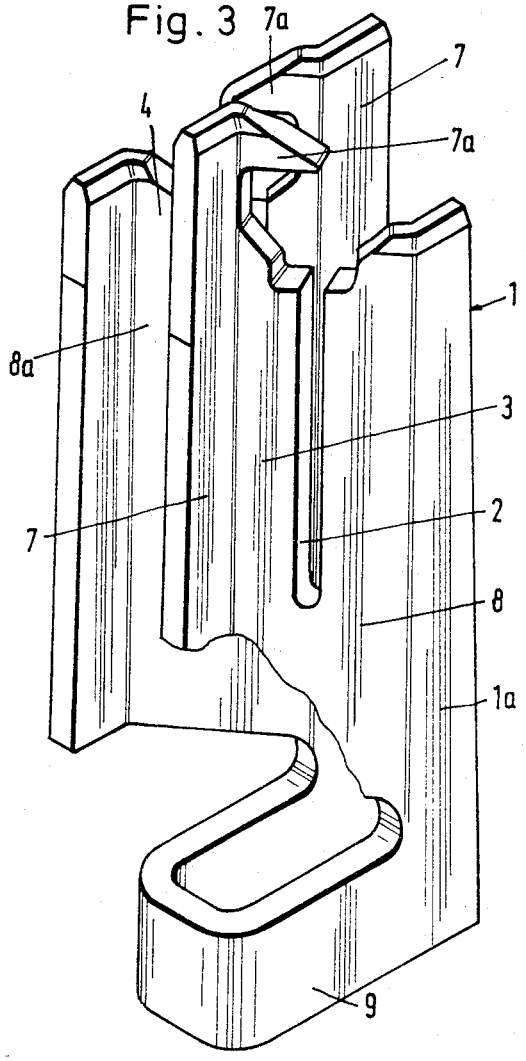
FIG. 3 is a terminal element designed as a double-contact.
Figure 4:
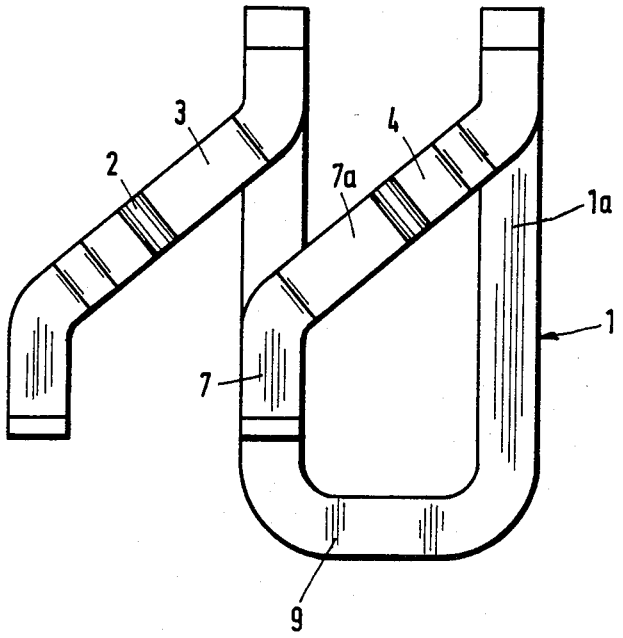
FIG. 4 is a plan view of FIG. 3.

The FIGS. 3 and 4 show the terminal element 1 as a double-contact 1*a*. Two wires, which are joined to each other and are disposed in side-by-side relationship may successively, one at a time, be connected and disconnected. The central webs 7 are extended in an upward direction and are provided at their ends with retaining means 7*a*, thereby serving as guide means for the wire to be terminated. The multiple terminal element of FIGS. 5 and 6 function in the same way.

The two contact members 8, 8*a* of the terminal element 1 are joined in their lower portion to a connecting member 9 of U-shaped cross-section.

The FIGS. 5 and 6 show a multiple terminal element 1*b*.

It is possible by means of a multiple terminal element to connect and disconnect any desired number of wires.

The connecting or disconnecting operation may take place either successively or simultaneously without affecting adjacent wires. Here, too, the individual contact members 8, 8*a*, 8*b* and 8*c* are joined to each other by U-shaped connecting webs 9.

It is apparent from FIG. 6 that here, too, the transverse webs 3, 4, 5 and 6 advantageously are disposed parallel to each other.

The alternative embodiment of FIG. 7 shows that beneath the terminal element 1 a U-shaped extension 10 is integrally formed, one of the legs 10*a* of which is resiliently formed as one half of a contact member 11.

The arrester magazines or testing and breaking plugs—not shown—which are adapted to be inserted into openings 12*a* of terminal strip 12 are tapped at this contact member 11.

FIG. 8 shows a further embodiment.

Here, the extension 14 is designed as an independent component element. If required, it may be inserted into a receptacle 13 provided beneath the terminal element 1.

In this case, too, the extension is formed with a resilient arm 14*a* which functions as one half of a contact member 15.

We claim:

1. A terminal element adapted to be mounted in a terminal strip, said terminal strip having the capability of retaining a plurality of said terminal elements, said terminal element comprising:

at least one pair of contacts made of resilient contact material, each said contact having a vertically extending slot with an open upper end for solderless, non-screwed and unstripped termination of at least one wire having insulation;

each said contact including a transverse web containing said slot and disposed at approximately 45° to the axis of the wire inserted in said slot, each said slot being defined by sharp edges and having a width which, due to the inclined orientation between said inserted wire and said contact, is smaller than the size of the metal core of the inserted wire so that when said wire is inserted in said slot, the wire insulation is severed by said sharp edges and electrical contact is made between said wire and said contact;

said transverse webs of said at lest one pair of contacts being in parallel relationship, each said contact having front and rear web portions extending from the respective ends of said transverse web, the front portion of one of said contacts and the rear portion of the other of said contacts being disposed in colinear relationship whereby the axial spacing of a pair of wires inserted into said slots of said pair of contacts is limited only by the wall thickness of said front and rear portions of said contacts;

said front and rear web portions including a horizontally extending portion disposed above said respective slot upper end opening in overlying, spaced-apart relationship therewith for guiding the wire as it is inserted into said slot; and a connecting member below said slots at the lower end of said contacts for interconnecting said contacts.

2. The terminal element recited in claim 1 and further comprising:

a U-shaped extension extending below said connecting member and said contact member, said extension having an arm resiliently formed as one-half of a contact member, whereby when two said terminal elements are positioned adjacent to each other, said arms form a complete contact member.

3. The terminal element recited in claim 1 and further comprising:

receptacle means integrally formed beneath said terminal element; and a U-shaped extension adapted to be inserted into said receptacles, each said extension being formed with a resilient arm forming one-half of a contact member, whereby when two said terminal elements are positioned adjacent to each other, said arms form a complete contact member.

* * * * *